United States Patent [19]

Cameron

[11] 4,449,673

[45] May 22, 1984

[54] REDUCTION MILL

[75] Inventor: Wallace C. Cameron, San Pedro, Calif.

[73] Assignee: Copper Alloys Corporation, Beverly Hills, Calif.

[21] Appl. No.: 306,758

[22] Filed: Sep. 29, 1981

[51] Int. Cl.[3] ..... B02C 13/286

[52] U.S. Cl. ..... 241/186 R; 241/189 R; 241/285 A

[58] Field of Search ..... 241/73, 86.2, 89, 186 R, 241/189 R, 189 A, 190, 285 A, 285 B, 82

[56] References Cited

U.S. PATENT DOCUMENTS

| | | | |
|---|---|---|---|
| 1,625,554 | 4/1927 | Liggett . | |
| 3,918,649 | 11/1975 | Miller | 241/285 A X |
| 4,009,836 | 3/1977 | Strom et al. | 241/73 |
| 4,049,206 | 9/1977 | Konig et al. | 241/189 A X |
| 4,146,184 | 3/1979 | Whitney | 241/73 |
| 4,226,375 | 10/1980 | Cameron | 241/189 R X |

OTHER PUBLICATIONS

"Bypass Products Scrap Shredders", in Recycling Today, Jul. 1980.

*Primary Examiner*—Mark Rosenbaum
*Attorney, Agent, or Firm*—I. Morley Drucker

[57] ABSTRACT

A more efficient reduction mill is described having, with a rotating hammer mill, a readily displaceable grate assembly system entirely pivotally displaced by power means, as a single unit, from the hammer mill portion to achieve ready access to the grate assembly for reversal or replacement of worn sections in combination with a pivotally displaceable by-pass door, which when displaced to a first position permits quick, safe and efficient removal of uncrushable materials from the product stream of the reduction mill without stopping mill rotation. The pivotal displacement of the by-pass door is selectively powered by the same power means or unit which pivotally displaces the grate system for access to the rotor and grate assembly. Such system employing a common power means for selective pivotal displacement of grate system and/or by-pass door permits a more cost-efficient means of achieving size reduction of a variety of materials, and permits also complete and ready access to the rotary hammer mill portion.

10 Claims, 5 Drawing Figures

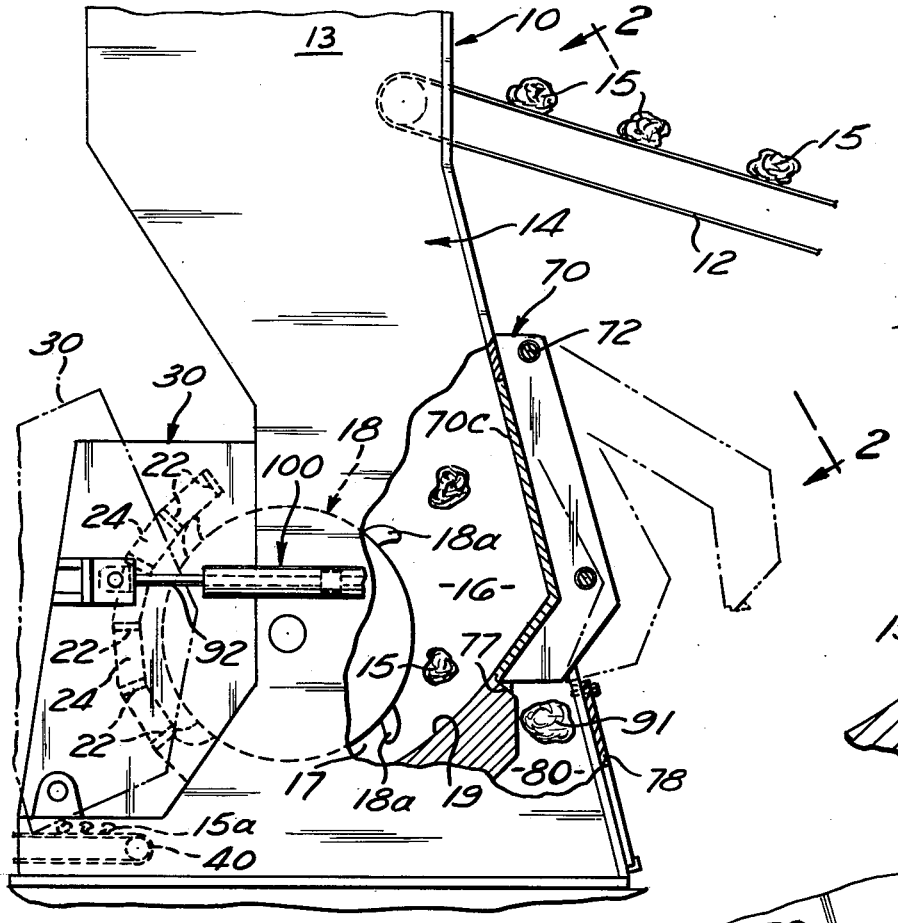
Fig. 1
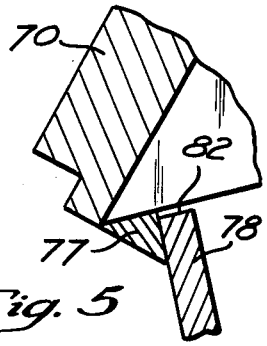
Fig. 5
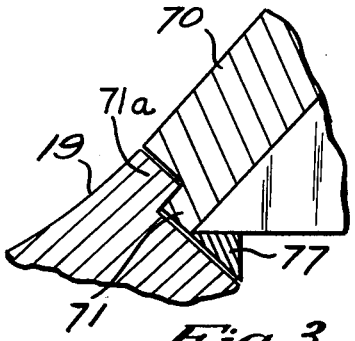
Fig. 3
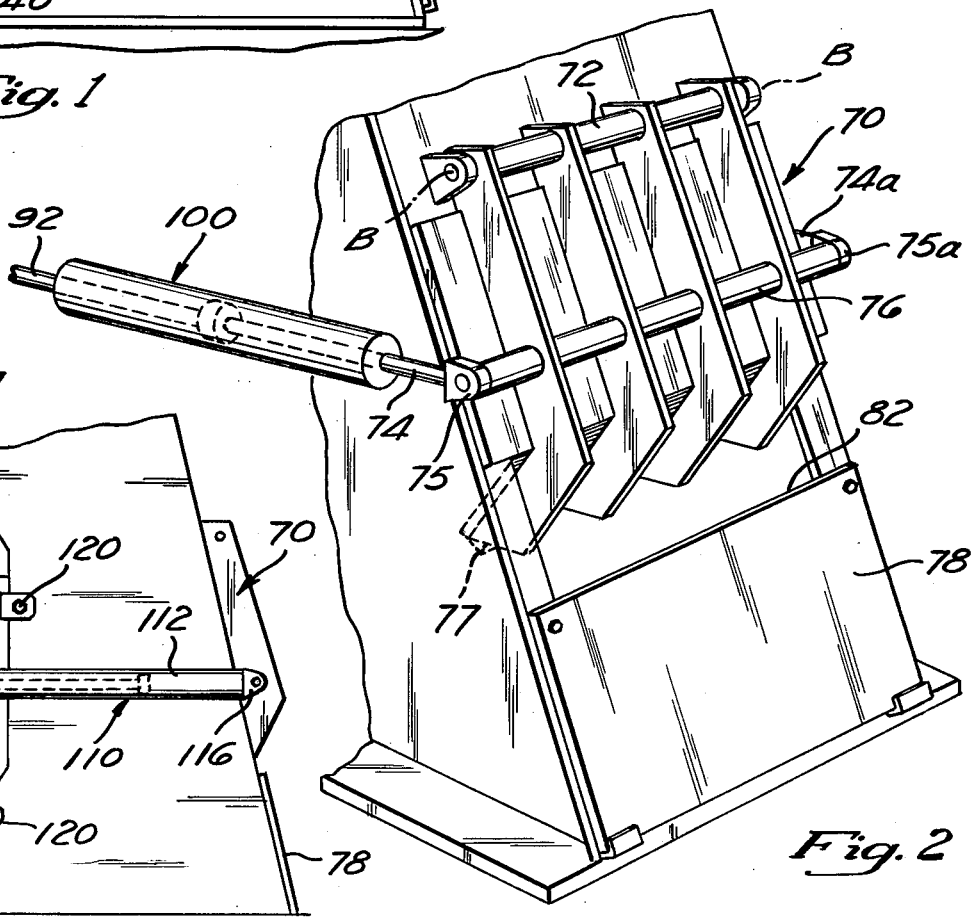
Fig. 2
Fig. 4
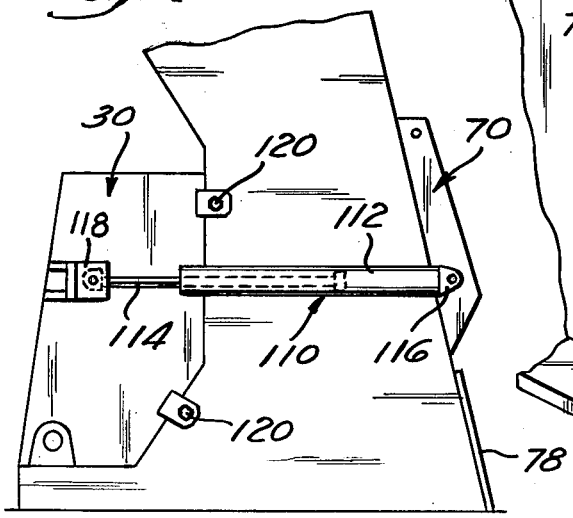

REDUCTION MILL

FIELD OF THE INVENTION

The invention herein lies in the field of improvements in reduction mills employing rotary hammer mills. The term "reduction mill" as used herein includes reduction mills operating on a rotary shear principle, shredders, fragmentizers, and pulverizers, all for the purpose of size reduction of a variety of materials including metals, ores and slags, and solid wastes from municipalities and the like.

BACKGROUND OF THE INVENTION

It will be understood that because of the tremendous impact forces acting upon the grate assembly by virtue of the high speed rotation of the hammers as they reduce, by shear crushing, etc. metallic materials such as auto bodies, small motors, ores, slags, solid wastes, and the like, there is a great need for an extremely efficient means for obtaining rapid access and entry to both the grate system and the hammers of the hammer mill to replace worn parts, or to reverse certain grate components to present fresh shearing surfaces—all for the purpose of maintaining, as closely as possible, the optimum dimensional relationship between hammers and grate assembly, with minimum down-time, for a wide variety of materials ranging from municipal wastes to fractional horsepower motors.

The grate assembly system of my previous invention patented in U.S. Pat. No. 4,226,375 issued on Oct. 7, 1980 and entitled "Reduction Mill" incorporates therewith a series of spaced cutter bars, these cutter bars coacting with rotating hammers of the hammer mill section to effect size reduction by shear, as well as by crushing or pulverizing of the material entering the mill charging area. The entire grate assembly system is concentrated within an approximately 140°-170° arc mounted in the side of the reduction mill, i.e., over an arc extending from approximately 6:30 to 11:30 o'clock. The entire grate assembly system is mounted within a grate housing that is pivotally mounted so as to be readily disengaged from, and re-engageable with, the mill cage housing or zone. Pivotal disengagement and re-engagement of the grate housing is optimally made under power means, such as an hydraulic ram or piston.

There are major advantages to the mode of assembly of grate components described in my aforesaid U.S. Pat. No. 4,226,375. First, the concentration of all grate components over a 6:30 to 11:30 o'clock arc of 140°-170° in combination with the entire pivotal disengagement thereof enables every component of the grate system to be readily accessible for reversibility or replacement. It also permits the hammers of the rotary hammer mill to be readily accessible for inspection and/or replacement. Ready accessibility enables predetermined tolerances to be more readily attained. The side discharge permits the entire bottom of the mill to be a solid anvil wall and to be placed upon on-grade foundations rather than requiring foundations to be dug below grade in pits or the like—as is the case in bottom discharge mills.

Rotary hammer mills generate tremendous impact forces on the material to be comminuted by virtue of the high speed rotation of the hammers. Occasionally an oversize piece of uncrushable material is inadvertently fed to the reduction mill. If the reduction mill is not quickly stopped and/or the uncrushable material rapidly removed, internal damage to the hammer mill portion, or to other portions of the reduction mill may occur. The oversize piece may even be caused to ricochet and be ejected rearwardly from the entrance to the reduction mill, and become a severe, perhaps even fatal safety hazard to human beings working in the vicinity of the reduction mill.

Pivotal displacement of by-pass doors, permitting removal of uncrushable materials from a reduction mill of the type employing rotary hammer mills, are known in the art. The following prior art offers various solutions to the problem of removal of uncrushable materials:

| PATENTEE | U.S. PAT. NO. | ISSUED |
|---|---|---|
| Liggett | 1,625,554 | 4/19/27 |
| Konig et al. | 4,049,206 | 9/20/77 |
| Whitney | 4,146,184 | 3/27/79 |

Recycling Today, Page 138, July 1980

Liggett's grate system is formed in two parts, one part fixed, and one part displaceable. The displaceable portion of the grate system is pivotally displaceable to permit escape of uncrushables. No means is provided in Liggett for providing ready access to the entire grate system (because one portion is fixed) for replacement, repair, etc. The Liggett reduction mill, while permitting uncrushables to exit from the mill, by means of an opening provided by a pivotally displaceable portion of the grate system, intermingles oversize uncrushables with the sized product stream thus resulting in an inferior product—since the product is usually sold on the basis of size of comminuted product.

Konig's trash comminuter permits removal of uncrushables by displacement of the grate system components from the rotor portion of the reduction mill by two separately powered units and operations. Fine comminution of material must be discontinued until the uncrushables are removed because the grate system itself is displaced in order to remove the uncrushables. The oversize uncrushables enter the product stream.

Whitney, U.S. Pat. No. 4,146,184, also has a pivotally displaceable door, containing grate components. Displacement of the door, to permit removal of uncrushables, necessarily results in intermingling of the oversize uncrushable material with the product stream.

The July 1980 *Recycling Today* publication describes a scrap shredder having a by-pass door which does not contain any grate components. The by-pass door may be pivotally displaced to permit removal of oversize uncrushable materials. The uncrushables intermingle with the product stream as in Whitney, Liggett and Konig.

These aforementioned patents and publication represent the closest prior art known to the invention described and claimed herein.

SUMMARY OF THE INVENTION

This invention comprises, in combination, a reduction mill with a rotating hammer mill, a readily displaceable grate assembly system entirely pivotally displaced by power means, as a single unit, from the hammer mill portion to achieve ready access to the grate assembly for reversal or replacement of worn sections in combination with a pivotally displaceable by-pass door, which when displaced to a first position permits quick, safe and efficient removal of uncrushable materials from the product stream of the reduction mill without stopping mill rotation. The by-pass door is angularly spaced approximately 100°-140° from the grate assembly structure and has a second position permitting access to the rotating hammer mill portion. The uncrushables never enter the product stream.

The pivotal displacement of the by-pass door is preferably selectively powered by the same power means or unit which pivotally displaces the grate housing for access to the grate assembly. Such system employing a common power means for selective pivotal displacement of grate system and/or by-pass door, permits a more cost-efficient means of achieving size reduction of a variety of materials, and permits also complete and ready access to the rotary hammer mill portion.

BRIEF DESCRIPTION OF THE DRAWINGS

FIG. 1 is a schematic drawing of the reduction mill, in side elevation, showing the rotary hammer mill and the grate system, together with the by-pass door of this invention, in partial cross-section;

FIG. 2 is a perspective view of the lower portion of the reduction mill of FIG. 1 as viewed from the rear thereof, that is, as seen generally in the direction of the arrow 2—2 (but in perspective);

FIG. 3 is an enlarged, fragmentary, cross-sectional view of the by-pass door abutment with the anvil wall of the rotor section;

FIG. 4 is a schematic, side elevational view of a second embodiment of common power means selectively operating the pivotally mounted grate assembly structure and the pivotally mounted by-pass door; and FIG. 5 is an enlarged, fragmentary view of the by-pass door junction with the lower rear wall of the reduction mill.

DETAILED DESCRIPTION OF THE PREFERRED EMBODIMENT

A reduction mill 10 is shown, in fragmentary schematic form, in FIG. 1, incorporating a rotary hammer mill 18 and grate means or grate assembly structure 20 of the type shown and described in my previous U.S. Pat. No. 4,226,375, incorporated herein by reference. The reduction mill 10 is provided with an inlet conveyor 12 of conventional type, bringing any of a number of types of material 15, to be reduced in size, into the feed bonnet 13 at the top of the mill 10. The material 15 to be processed may be metallic (ferrous or non-ferrous), glass, ore, slag, small motors, or municipal wastes, set forth herein, by way of example only. The material to be processed then drops into and through a charging area 14 and into the actual size reduction zone or mill cage zone 16.

The material 15 moves from the mill cage zone 16 under the influence of the high-speed rotation of hammers 18*a* of hammer mill 18 into the ever-decreasing channel area 17, defined by the anvil wall 19 and the hammer mill 18. The hammer mill 18 and the anvil wall 19 are formed from specially hardened, but conventional, metallic materials.

The grate assembly structure 20 is placed within a grate housing 30 so that all elements forming the grate assembly structure are concentrated within an arc extending over, preferably, about 140°-170°. The grate means is further located at from about the 6:30 to 11:30 o'clock position with reference to the axis of rotation of the hammer mill 18. Material 15, after being comminuted to the appropriate size for passage through the openings of the grate means 20, will then pass through the open bottom of the grate housing 30 (not shown) and onto the outlet conveyor means 40 (conventional type) moving, in endless fashion, from the lower side, or corner of the hammer mill 10.

The grate assembly structure 20 comprises a series of screen bars 24 alternating with cutter bars 22, as shown in FIG. 1, and includes grate housing 30. Further details are shown and described in the U.S. Pat. No. 4,226,375.

It will be realized that as material 15 is processed, in the reduction mill 10, the hammers 18*a* of the rotary hammer mill 18 (with or without replaceable tips or caps for hammers 18*a*) will coact with cutter bars 22 of grate assembly to exert major forces in shear resulting in ready and efficient comminution of material. Such material 15 exits the grate assembly 20, through appropriate openings in the screen bars 24 and is discharged from the mill 10 via conveyor 40, as earlier set forth.

A by-pass door 70 is provided at the rear of, and adjacent, the mill cage zone 16 between about 100°-140° removed from the grate assembly structure 30, as measured between the closest lines of proximity of the grate structure and by-pass door. The by-pass door 70 is pivotally mounted to the reduction mill 10 about upper fulcrum rod 72, and is displaceable about the pivot axis B—B of fulcrum rod 72, under power means, such as hydraulically operated power units 100, one only of which is schematically shown in FIG. 2, the other unit (not shown) being mounted for movement in parallel therewith. The power units 100 are mechanically linked through piston rods 74, 74*a*, bushings 75, 75*a* and transverse support rod 76 to power the door 70. When the pair of hydraulic ram units 100 are actuated the piston rods 74, 74*a* will move to the right, as shown in FIGS. 1 and 2, and force support rod 76 to the right, enabling pivotal displacement of the door 70 about pivot axis B—B to a first position 70*a*.

Position 70*a* of the door is an intermediate position of the door immediately adjacent a lower bolted-on access panel 78. The door 70 attains the first position 70*a* by means of abutment of stop member 77 with the upper end 82 of panel 78, as shown in FIG. 5. In the intermediate door position 70*a*, access to a well or cavity means 80 behind anvil wall 19 is provided. However the uncrushable material cannot escape from the reduction mill 10 proper because of the abutment of the stop member 77 of the by-pass door 70 with the upper end 82 of the access panel 78.

The displacement of door 70 to the intermediate position 70*a* occurs without interruption of the ongoing reduction of crushable material, such size reduction being provided by the interaction of grate structure 30 together with the rotating hammer mill 18.

An important feature of this invention is that mill rotation may continue while the uncrushable material exits from the mill cage zone 16 and into cavity means 80. In this connection, the downward slope of the inner surface 70*c* of the door 70 is to be noted. The uncrushable material will more readily ricochet downwardly into cavity means 80 striking this downwardly sloping surface 70*c* as indicated by dotted arrow C—C in FIG. 1. Another important feature is that the oversize uncrushables, designated 91 in FIG. 1, never enter the product stream 15*a*, the product stream continuing to exit via grate assembly structure 30 throughout the process of removal of uncrushable 91 via displacement of by-pass door 70. It is to be noted that the product discharge section, being physically separate and approximately 100° or more removed from cavity 80 means permits oversize uncrushable material to be discharged into the cavity without entering the product discharge stream 15*a*.

When overize uncrushable material enters the mill cage zone 16, its presence is usually immediately detected by the operator by means of an extremely loud repetitive noise within the reduction mill caused by internal ricocheting of the oversize uncrushable material within the reduction mill 10. The operator may then immediately switch the hydraulic ram unit to door position 70*a* thereby exposing an exit opening into cavity means 80 for the uncrushable material 91, in the manner just described. The precise positioning of door position 70*a* may also be accomplished by an electrically operated limit switch (not shown) as an alternative to the provision of a stop member 77 as the positioning or stop means.

When access to the rear of the reduction mill 10 is required, e.g., to remove the uncrushables, this can be accomplished by removing bolt-on panel 78, and then displacing door 70 to position 70*b* (by further movement of piston 74 to the right as viewed in FIGS. 1 and 2). The bolt-on panel 78 may also be hingedly mounted about a lower pivot axis (not shown) for easier movement, if desired.

Another feature of this invention is the provision of a power means comprising a pair of single, parallel, hydraulic ram units 100 to pivotally and selectively displace either, or both, the grate assembly structure 30 (i.e., grate housing and grate components 24, 22) and the by-pass door 70. The single ram units 100 are conventionally operated under hydraulic pressure to move either piston rod 92 (and its parallel rod, not shown) to the left, to pivotally displace the grate structure 30, or to move piston rods 74, 74*a* to the right to effect pivotal displacement of the by-pass door as described. The pair of ram units 100 are also operable to move piston rods 92 (and its twin), 74, 74*a* to displace both grate assembly 30 and by-pass door simultaneously and achieve maximum access to the mill cage zone 16.

The use of a common hydraulic power unit operating both pivotally displaceable units of the reduction mill is relatively simple and highly cost efficient, and is a feature of this invention.

Referring to FIG. 3, the normally closed position of the by-pass door 70 with anvil wall 19 is shown, the stepwise abutment of door 70 with anvil wall 19 being presently preferred.

Referring to FIG. 4, a second and alternative embodiment of common power means 110 for the displaceable by-pass door 70 and the grate assembly structure 30 is shown. In this embodiment, the common power means 110 comprises a pair of parallel single hydraulic cylinders 112 and single piston rods 114 contained therein (only one cylinder and rod being shown). The cylinders 112 each have one end 116 fixed to the by-pass door 70, and the other end 118 linked to piston rod 114. In this embodiment, the grate assembly 30 is securely locked or bolted to the body of reduction mill 10 so that, in the event of an oversize uncrushable being presented, hydraulic pressure will be exerted upon the power means 110, the piston rod 114 will (because the grate structure 30 is bolted) cause the by-pass door 70 to move to the right (until door position 70*a* is achieved). When the door 70 is to be moved back to the normally closed position, the power means 110 is permitted to release its fluid pressure until the position shown in FIG. 3 is reached. In the FIG. 3 position, lower lip 71 of door 70 abuts limiting shoulder means 71*a* of anvil wall 19. When the grate assembly structure is to be pivotally displaced together with by-pass door 70, the bolts 120 are removed, and the power unit 110 actuated until both structures are displaced to their fully opened positions as shown in dotted lines in FIG. 1. The power means 110 is somewhat simpler and less expensive to manufacture than the power means 100 of FIG. 1 but is not quite as versatile.

Modifications will become apparent to those skilled in the art. I intend therefor to be bound only by the claims which follow.

I claim:

1. In a reduction mill having a rotary hammer mill and an anvil wall in a mill cage zone, and a grate assembly structure, including grate components, pivotally displaceable with respect to said rotary hammer mill to provide access to both said grate assembly structure and said rotary hammer mill, and said grate assembly structure containing all of the said grate components for said reduction mill, including a product discharge section, the improvement which comprises:

a pivotally displaceable by-pass door for uncrushable materials, said by-pass door being displaceable from a position abutting the anvil wall of said reduction mill to an intermediate position adjacent a lower rear wall of said reduction mill to thereby expose an opening from said mill cage zone to a cavity means behind said anvil wall and thereby permit passage of uncrushable material from said mill cage zone to said cavity means without interrupting operation of said rotary hammer mill, said cavity means being angularly spaced from said grate assembly structure; and a common power means connected to each of said by-pass door and said grate assembly structure, each of said by-pass door and said grate assembly structure being selectively displaceable by said common power means to a position displaced from their normal operating positions in said reduction mill.

2. The improvement of claim 1 wherein said by-pass door is angularly spaced between approximately 100°–140° from said grate assembly structure.

3. The improvement of claim 1 wherein said by-pass door has an inner surface that is downwardly sloping whereby uncrushable material will ricochet downward into said cavity means.

4. The improvement of claim 1 wherein said product discharge section is physically separate, and at least 100° angularly spaced, from said cavity means whereby uncrushable material discharging into said cavity means does not enter the product discharge section.

5. The improvement of claim 1 wherein said by-pass door is displaceable to a position external of said reduction mill body to permit access to said mill cage zone.

6. The improvement of claim 1 wherein each of said by-pass door and said grate assembly structure are simultaneously displaceable by a common power means to a position displaced from their normal operating positions with said reduction mill.

7. The improvement of claim 1 wherein each of said by-pass door and said grate assembly structure are each selectively displaceable by a common power means to a position displaced from their normal operating positions with said reduction mill.

8. The improvement of claim 1 wherein said common power means selectively powers piston means for each of said grate assembly structure and said by-pass door.

9. The improvement of claim 1 wherein said common power means delivers power directly to said grate assembly structure only and said grate assembly structure is bolted to the body of said reduction mill during displacement of said by-pass door.

10. The improvement of claim 1 wherein each of said by-pass door and said grate assembly structure are simultaneously displaceable by a common power means to a position displaced from their normal operating positions with said reduction mill.

* * * * *